United States Patent [19]

Tajima et al.

[11] Patent Number: 4,848,764

[45] Date of Patent: Jul. 18, 1989

[54] SHEET FEEDING MECHANISM

[75] Inventors: Kenji Tajima; Hiroshi Kushima, both of Kanagawa, Japan

[73] Assignee: Fuji Photo Film Co., Ltd., Kanagawa, Japan

[21] Appl. No.: 53,907

[22] Filed: May 26, 1987

[30] Foreign Application Priority Data

May 23, 1986 [JP] Japan ..... 61-119976
Nov. 29, 1986 [JP] Japan ..... 61-284476

[51] Int. Cl.[4] ..... B65H 3/08
[52] U.S. Cl. ..... 271/90; 271/107
[58] Field of Search ..... 271/107, 102, 106, 103, 271/20, 211, 90, 132, 194, 95, 104, 105; 414/120, 121; 74/54, 99 A, 107, 99 R, 104, 110

[56] References Cited

U.S. PATENT DOCUMENTS 3,797,822 3/1974 Anderson ..... 271/107 X
4,418,906 12/1983 Scott ..... 271/107 X
4,589,649 3/1986 Prescher ..... 271/107

FOREIGN PATENT DOCUMENTS 248831 11/1986 Japan .

*Primary Examiner*—Joseph J. Rolla
*Assistant Examiner*—Stephen B. Parker
*Attorney, Agent, or Firm*—Sughrue, Mion, Zinn, Macpeak & Seas

[57] ABSTRACT

A sheet feeding mechanism for feeding stacked sheets one by one from a sheet magazine includes a plurality of suction cups coupled to a vacuum suction device for attracting one sheet at a time, and an arm member on which the suction cups are securely mounted. At least one rotatable bearing is operatively coupled to the arm member and rollingly movable in a guide groove having at least one curved or bent guide opening. The bearing is movable by a slider in and along the guide opening to angularly move the arm member and hence the suction cups for thereby swaying and feeding a sheet held by the suction cups.

10 Claims, 7 Drawing Sheets

SHEET FEEDING MECHANISM

BACKGROUND OF THE INVENTION

The present invention relates a sheet feeding mechanism, and more particularly to a sheet feeding mechanism for reliably feeding sheets such as sheet films, one by one, from a stack of stored sheets.

Radiation image recording apparatuses are in general use for recording radiation images on photosensitive films through exposure to X-rays for subsequent use in medical diagnosis or the like. The photographic films are loaded in the radiation image recording apparatus under light-shielded conditions so that the films will not be exposed to extraneous light. The image of an object is recorded on a loaded photographic film by exposing the emulsion layer of the film directly to X-rays.

There has recently been developed and widely used, particularly in the medical field, a radiation image recording and reproducing system for producing the radiation-transmitted image of an object using a stimulable phosphor material capable of emitting light upon exposure to stimulating rays. When a stimulable phosphor is exposed to radiation such as X-rays, $\alpha$-rays, $\beta$-rays, $\gamma$-rays, cathode rays, or ultraviolet rays, the phosphor stores a part of the energy of the radiation. When the phosphor exposed to the radiation is subsequently exposed to stimulating rays such as visible light, the phosphor emits light in proportion to the stored energy of the radiation.

In the radiation image recording and reproducing system employing such a stimulable phosphor, the radiation image information of an object such as a human body is recorded on a sheet having a layer of stimulable phosphor, and then the stimulable phosphor sheet is scanned with stimulating rays such as a laser beam to cause the stimulable phosphor sheet to emit light representative of the radiation image. The emitted light is then photoelectrically detected to produce an image signal which is electrically processed to generate image information which is recorded on a recording medium such as a photographic photosensitive material or displayed as a visible image on a CRT or the like.

The visible image thus produced may be recorded on a recording medium by an image recorder such as an image output laser printer, for example. In the image output laser printer, photographic recording sheet films are stacked in a magazine, loaded, and taken out one by one by a sheet feeding mechanism including a suction cup or the like. Thereafter, the film is exposed to a laser beam modulated by an signal produced from the stimulable phosphor sheet for recording an image on the film. The exposed film is then transferred into an automatic developing device and processed thereby to develop the image. The film is thereafter stored in a prescribed place or directly used in medical diagnosis.

Films to be delivered by the sheet feeding mechanism are stacked in the magazine, and hence tend to stick to adjacent sheets due for example to static electricity. Therefore, when taking a film out of the magazine using the suction cup, one or more adjacent films are liable to stick to the film and hence a plurality of films are simultaneously fed from the magazine.

Japanese Laid-Open Paten Publication No. 56-132236 discloses a sheet feeding mechanism for taking films, one by one, out of magazine.

FIG. 1 of the accompanying drawings shows the disclosed sheet feeding mechanism, generally designated by the reference numeral 2. The sheet feeding mechanism 2 includes a support member 4 through which five tubular bodies 6*a* through 6*e* extend for slidable movement. Suction cups 8*a* through 8*e* are mounted on the distal ends of the tubular bodies 6*a* through 6*e*, respectively, and stoppers 10*a* through 10*e* are fixed to the tubular bodies 6*a* through 6*e*, respectively, at positions spaced given distances from the suction cups 8*a* through 8*e*. The stoppers 10*a* through 10*e* are located on the respective tubular bodies 6*a* through 6*e* such that when the support member 4 is positioned parallel to a sheet stack A, the suction cups 8*a*, 8*e* are closest to the sheet stack A, the suction cup 8*c* is remote from the sheet stack A, and the suction cups 8*b*, 8*d* are positioned between the suction cups 8*a*, 8*e* and the suction cup 8*c*. Coil springs 12*a* through 12*e* are disposed under compression between the suction cups 8*a* through 8*e* and the support member 4. The tubular bodies 6*a* through 6*e* are connected to a vacuum suction mechanism (not shown).

In operation, the support member 4 is displaced toward the sheet stack A until it reaches a position in which all of the suction cups 8*a* through 8*e* abut against the upper surface of an uppermost sheet A1. Then, the support member 4 is stopped, and the vacuum suction mechanism is actuated to cause the suction cups 8*a* through 8*e* to attract the sheet A1.

Then, the support member 4 is moved away from the sheet stack A. Upon such movement of the support member 4, the stopper 10*c* fixed to the tubular body 6*c* is first brought into engagement with the support member 4 under the influence of the coil spring 12*c*, thus displacing the suction cup 8*c* upwardly in FIG. 1. Therefore, a slight gap is created between the uppermost sheet A1 and next adjacent sheet A2. As the support member 4 is further displaced upwardly, the stoppers 10*b*, 10*d* are then brought into engagement with the support member 4 by the bias forces of the coil springs 12*b*, 12*d* to move the suction cups 8*b*, 8*d* upwardly. Finally, the suction cups 8*a*, 8*e* are moved upwardly, and hence all of the suction cups 8*a* through 8*e* are displaced upwardly to deform the sheet A1 in an upwardly curved shape as shown in FIG. 1.

Consequently, a space is developed between the sheets A1, A2, so that the sheet A2 will not be fed with the sheet A1. As a result, sheets can be fed one by one from the sheet stack A by the sheet feeding mechanism 2.

With the conventional sheet feeding mechanism 2, however, since the sheets are curved by the suction cups 8*a* through 8*e*, the lengths of the tubular bodies 6*a* through 6*e* on which the suction cups 8*a* through 8*e* are mounted, respectively, must be appropriately selected. More specifically, the tubular body 6*c*, the tubular bodies 6*b*, 6*d*, and the tubular bodies 6*a*, 6*e* have at least three respectively different lengths. This is disadvantageous in that the process of fabricating the tubular bodies is made more complex and costly. In addition, the tubular bodies must be associated with coil springs of different lengths, and it is also tedious and time-consuming to select suitable spring lengths, manufacture coil springs of such different lengths, and adjust the coil springs so as to best suited to the associated tubular bodies. Another drawback is that after the sheet A1 has been fed from the sheet stack A, the sheet A1 is held in the curved configuration, and, therefore, the feed path following the sheet feeding mechanism 2 should be of such a structure as to be able to accommodate the curved sheet A1. The feed path of such a structure is, however, complicated.

SUMMARY OF THE INVENTION

It is a primary object of the present invention to provide a sheet feeding mechanism of a simple construction including tubular bodies of identical length and suction cups securely mounted on the arm member, and a guide member such as a bearing or bearings coupled to the arm member, the guide member being fitted in a groove defined in a guide plate and displaceable along the shape of the groove to swing the arm member at least once to sway a sheet held by the suction cups, so that stacked sheets can be reliably taken one by one out of a magazine.

Another object of the present invention is to provide a sheet feeding mechanism comprising suction means for holding and successively feeding stacked sheets, the suction means including a plurality of suction cups coupled via tubes to a vacuum suction device, an arm member on which the suction means is securely mounted, a guide member operatively engaging the arm member and fitted in a guide opening, and drive means actuatable for displacing the guide member along the shape of the guide opening to angularly move the arm member to thereby sway and feed a sheet held by the suction cups.

Still another object of the present invention is to provide a sheet feeding mechanism comprising suction means for holding and successively feeding stacked sheets, the suction means including a plurality of suction cups coupled via tubes to a vacuum suction device, an arm member on which the suction means is securely mounted, and a first fixed guide member and a second movable guide member for displacing the arm member along a prescribed path, the arrangement being such that when a sheet is held by the suction cups, the arm member is swingably displaceable by the second guide member to sway the sheet held by the suction cups.

The above and other objects, features and advantages of the present invention will become more apparent from the following description when taken in conjuction with the accompanying drawings in which preferred embodiments of the present invention are shown by way of illustrative example.

DESCRIPTION OF THE PREFERRED EMBODIMENTS

Figure 1:
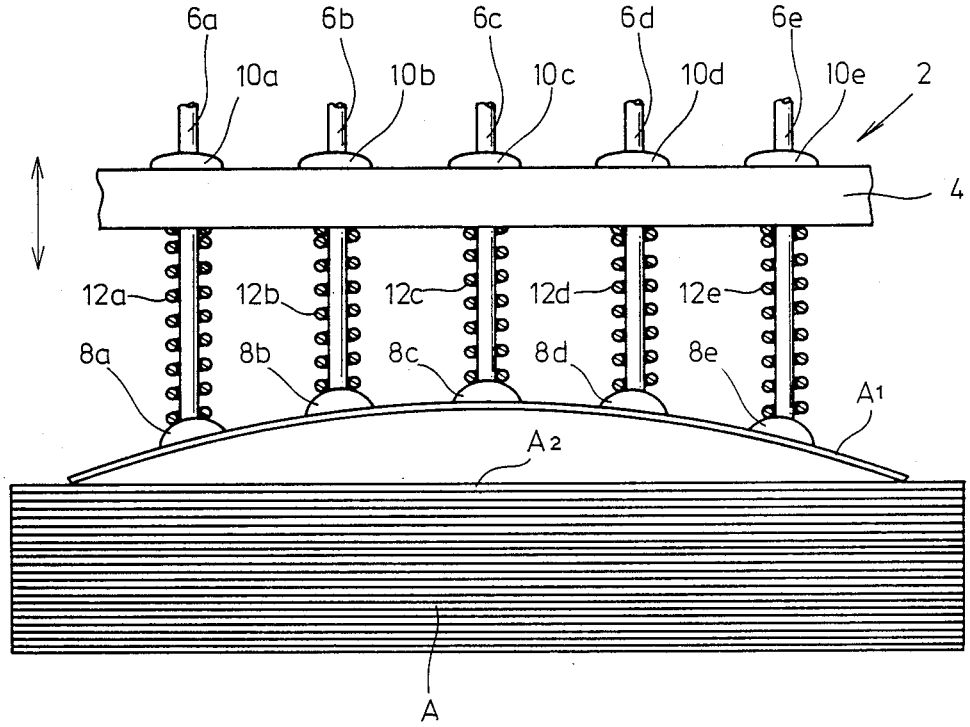
FIG. 1 is a schematic elevational view of a conventional sheet feeding mechanism.

Like or corresponding parts are denoted by like or corresponding reference characters throughout the several views.

Figure 2:
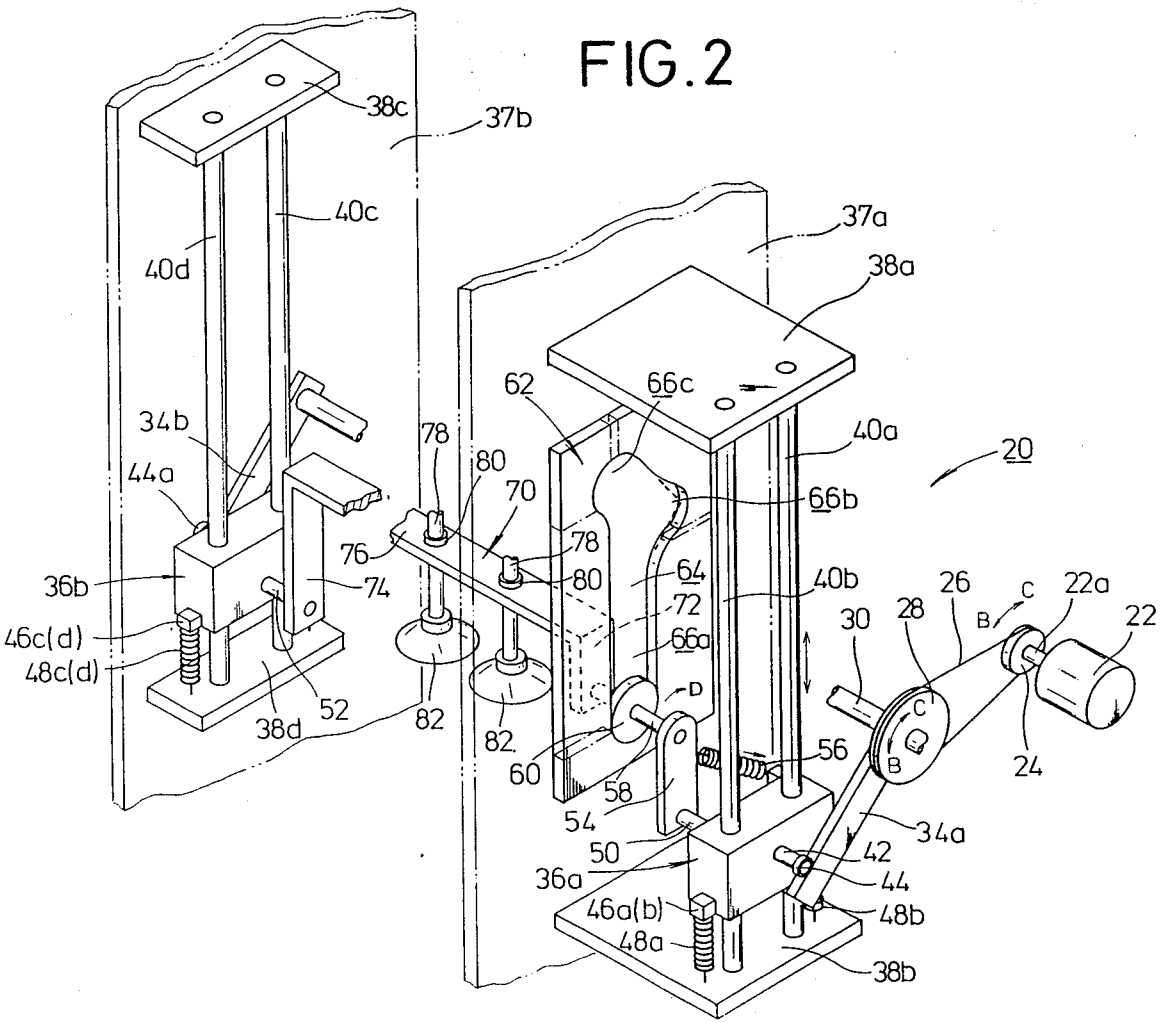
FIG. 2 is a fragmentary perspective view of a sheet feeding mechanism according to the present invention.

As shown in FIG. 2, a sheet feeding mechanism, generally denoted by the reference numeral 20, according to the present invention includes a rotational drive source 22 such as an electric motor having a rotatable drive shaft 22a supporting thereon a first sprocket 24. A chain 26 is trained around the first sprocket 24 and a second sprocket 28 mounted on one end of a rotatable shaft 30. The rotatable shaft 30 has its opposite ends fixed to ends of plate-like swing arms 34*a*, 34*b*, respectively, which engage sliders 36*a*, 36*b*, respectively.

A pair of attachment plates 38*a*, 38*b* vertically spaced from each other are attached to a support plate 37*a* erected in an image recording apparatus (not shown). To and between the attachement plates 38*a*, 38*b*, there is secured a pair of vertical guide bars 40*a*, 40*b* extending parallel to each other, the slider 36*a* being slidably supported on the guide bars 40*a*, 40*b*. A bearing 44 is rotatably supported by a support pin 42 on the slider 36*a*. The swing arm 34*a* has one end engaging the bearing 44. The slider 36*a* has projections 46*a*, 46*b* on opposite sides thereof, with coil springs 48*a*, 48*b* coupled between the projections 46*a*, 46*b* and the attachement plate 38*b*. A pin 50 is mounted on the surface of the slider 36a which is opposite to the support pin 42.

The slider 36*b* is of a structure similar to that of the slider 36*a*. A pair of guide bars 40*c*, 40*d* is secured to and between two vertically spaced attachment plates 38*c*, 38*d* affixed to a support plate 37*b*, the slider 36*b* being slidably mounted on the guide bars 40*c*, 40*d*. A bearing 44*a* is rotatably mounted on one surface of the slider 36*b*, the bearing 44*a* engaging the swing arm 34*b*. Coil springs 48*c*, 48*d* are coupled between the attachment plate 38*d* and projections 46*c*, 46*d* on opposite sides of the slider 36*b*. A pin 52 is mounted on the surface of the slider 36*b* which is opposite to the bearing 44*a*.

A connector plate 54 is swingably coupled at one end to the pin 50, and a coil spring 56 is coupled between the connector plate 54 and the slider 36*a*. The connector plate 54 is normally urged by the coil spring 56 to be angularly displaced in the direction of the arrow D. A fixed pin 58 is secured to the other end of the connector plate 54. A bearing or rotatable member 60 is supported on the fixed pin 58 at its substantially intermediate portion and engages in a guide plate 62.

The guide plate 62 is fixed to the support plate 37*a* and has a guide groove 64 in which the bearing 60 engages. The groove 64 includes a first opening 66*a* extending vertically upwardly to a prescribed length, a second opening curved to the right (FIG. 2), and a third opening 66*c* inclined leftwardly and upwardly from an end of the second opening 66*b*. The second opening 66*b* may be of a bent shape as indicated by the broken line in FIG. 2.

An arm member 70 engages the fixed pin 58 and the pin 52. The arm member 70 has a first arm 72 secured to the fixed pin 58, a second arm 74 swingably supported on the pin 52, the first arm 72 being shorter than the second arm 74, and a third arm 76 extending horizontally and integrally joined to the upper ends of the first and second arms 72, 74. A plurality of tubular bodies 78 extend through the third arm 76 in spaced relation to each other. The tubular bodies 78 are fixed to the third arm 76 through respective engaging members 80 on the tubular bodies 78. Suction cups 82 are mounted on ends of the tubular bodies 78, respectively, which are coupled at the other ends to a vacuum suction device [(not shown).]

The operation and advantages of the sheet feeding mechanism of the above construction will be described below.

Figure 3:
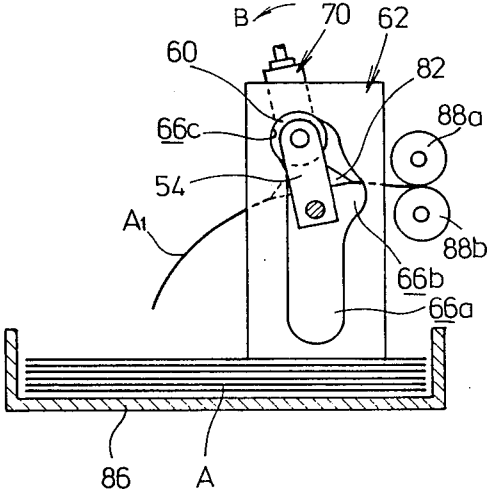
FIGS. 3(*a*), 3(*b*), and 3(*c*) are elevational views showing successive steps of operation of the sheet feeding mechanism of the invention.
Figure 3:
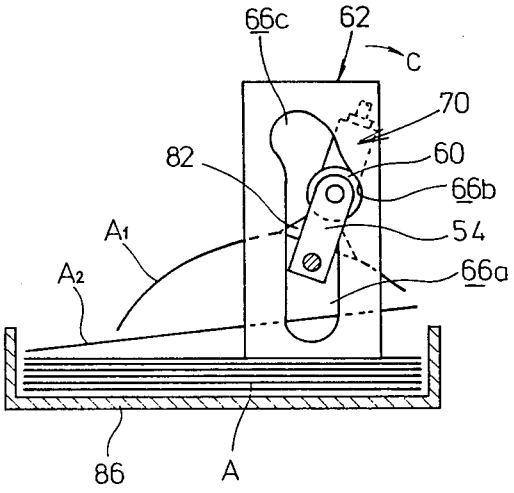
Figure 3:
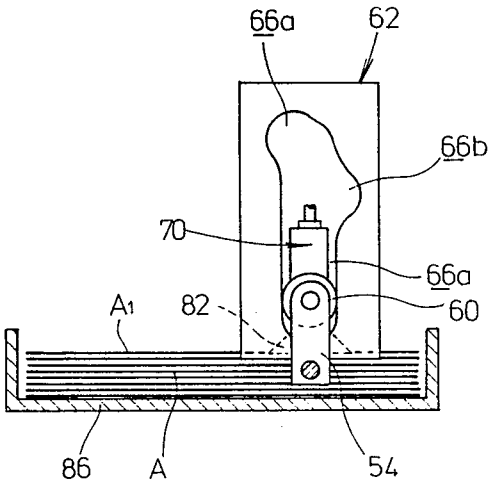

A process of taking out sheet films A, one by one, from a magazine 86 which contain a stack of such sheet films A will be described with reference to FIGS. 3(*a*) through 3(*c*).

The rotational drive source 22 is energized to rotate the drive shaft 22*a* about its own axis in the direction of the arrow B (FIG. 2). The first sprocket 24 coupled to the drive shaft 22*a* rotated also in the direction of the arrow B to cause the chain 26 to rotate the second sprocket 28. Therefore, the rotatable shaft 30 which supports the second sprocket 28 is also rotated to enable the swing arms 34*a*, 34*b* secured to the shaft 30 to swing in the direction of the arrow B. The sliders 36*a*, 36*b* engaging the swing arms 34*a*, 34*b*, respectively, are now displaced downwardly along the guide bars 40*a*, 40*b*, 40*c*, 40*d* under the bias of the coil springs 48*a*, 48*b*, 48*c*, 48*d*. The arm member 70 supported on the sliders 36*a*, 36*b* is thus displaced downwardly via the bearing 60 which is guided in the first opening 66*a* of the guide plate 62. The suction cups 82 on the tubular bodies 78 mounted on the arm member 70 are brought into resilient pressing engagement with the upper surface of the uppermost sheet film A1 stored in the magazine 86 through the use of the coil springs 48*a* through 48*d* (see FIG. 3(a)).

Then, the vacuum suction device (FIG. 4) is operated to enable the suction cups 82 to attract the sheet film A1, and the rotatable drive source 22 is rotated in the reverse direction. The drive shaft 22*a* is rotated about its own axis in the direction of the arrow C (FIG. 2) to cause the first sprocket 24, the chain 26, and the second sprocket 28 to rotate the shaft 30 in the direction of the arrow C, whereupon the swing arms 34*a*, 34*b* fixed to the shaft 30 are swung in the direction of the arrow C. Consequently, the sliders 36*a*36*b* engaging the swing arms 34*a*, 34*b*, respectively, are moved upwardly against the bias of the coil springs 48*a*, 48*b*, 48*c*, 48*d*, so that the arm member 70 is also moved upwardly through the bearing 60 guided in the first opening 66*a* of the groove 64. The suction cups 82 are lifted upwardly to take one end of the sheet film A1 out of the magazine 86.

The rotational drive source 22 is further actuated to displace the sliders 36*a*, 36*b* upwardly until the bearing 60 reaches the second opening 66*b* of the groove 64. Since the connector plate 54 is resiliently biased in the direction of the arrow D (FIG. 2) by the tension of the coil spring 56, the connector plate 54 is angularly moved about the pin 50 in the direction of the arrow D, whereupon the bearing 60 supported on the connector plate 54 by the fixed pin 58 is displaced along the curved edge of the second opening 66*b*. As a result, the arm member 70 affixed to the connector plate 54 by the fixed pin 58 is also tilted or angularly moved in the direction of the arrow D. At this time, as shown in FIG. 3(*b*), the suction cups 82 on the arm member 70 are angularly displaced to sway the sheet film A1 held by the suction cups 82. The next sheet film A2 which may have also been taken out of the magazine 86 in intimate contact with the sheet film A1 due for example to static electricity is now separated from the sheet film A and drops back into the magazine 86.

Continued energization of the rotational drive source 22 to displace the sliders 36*a*, 36*b* upwardly moves the bearing 60 out of the second opening 66*b* into the third opening 66*c*. The arm member 70 is angularly moved in the opposite direction of the arrow B (FIG. 3(c)) to position a leading end of the sheet film A1 held by the suction cups 82 between a pair of delivery rollers 88*a*, 88*b* held in rolling contact with each other. The rollers 88*a*, 88*b* are then rotated, and at the same time the vacuum suction device is activated, whereupon the sheet film A1 is sandwiched between the rollers 88*a*, 88*b* and delivered thereby into an image recording section (not shown).

Thereafter, the rotational drive source 22 is driven to rotate the drive shaft 22*a* in the direction of the arrow B (FIG. 2) to lower the sliders 36*a*, 36*b* to pick up the next sheet out of the magazine 88 by the same process as described above.

While in the above embodiment the guide plate 62 is composed of a single plate as shown in FIG. 2, the guide plate 62 may comprise a plurality of bent or curved plates as indicated by the dot-and-dash lines in FIG. 2 to faciliate the formation of the openings 66*a* through 66*c*. The configuration of the groove 64 may suitably be selected dependent on the direction in which the films A from the magazine 86 should be swayed or the position of the delivery rollers 88*a*, 88*b*.

Figure 4:
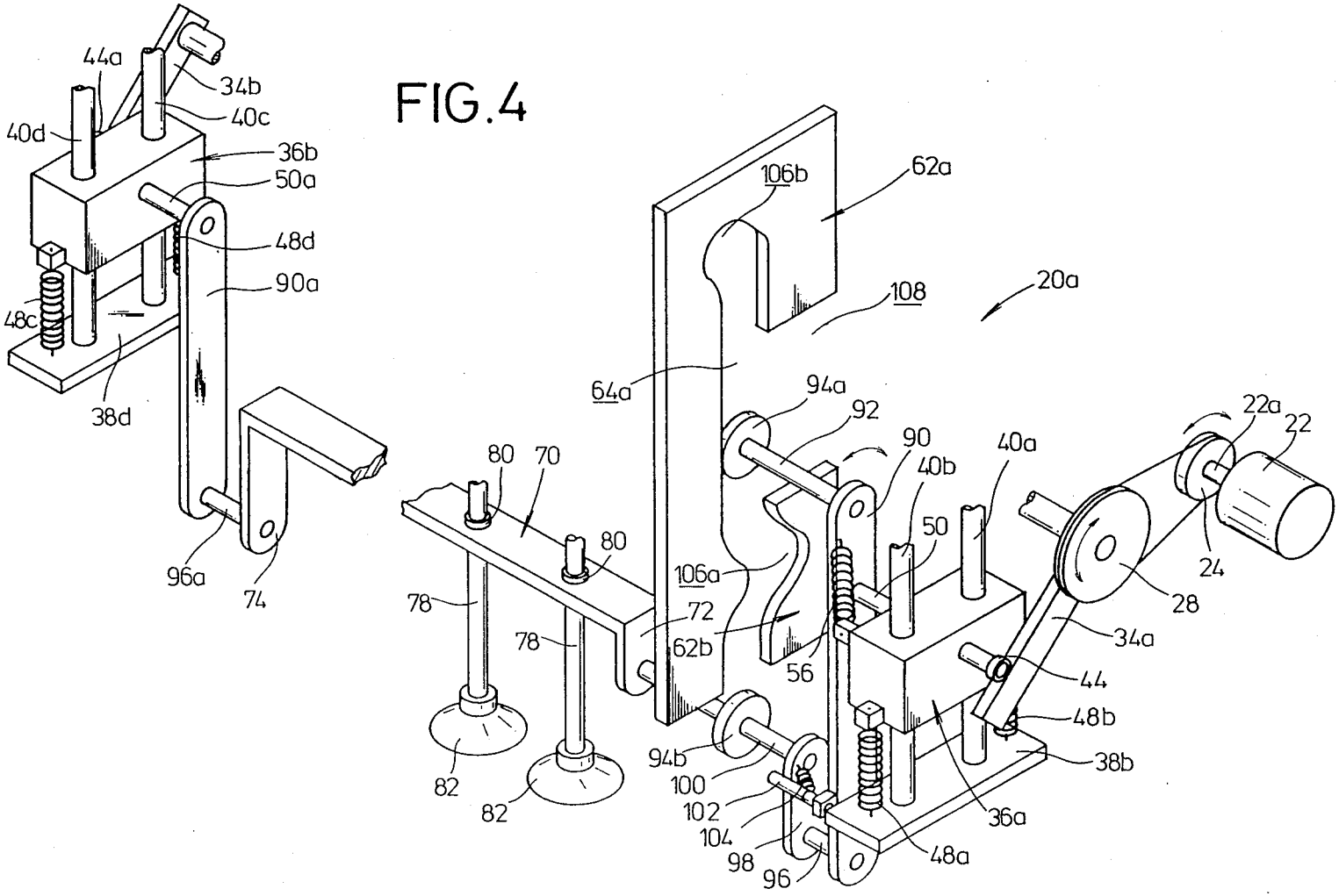
FIG. 4 is a fragmentary perspective view of a sheet feeding mechanism according to another embodiment of the present invention.

A sheet feeding mechanism according to another embodiment of the present invention will be described hereinbelow with reference to FIGS. 4 and 5(*a*) and 5(*b*).

A sheet feeding mechanism 20*a* includes a first connector plate 90 of a relatively large length swingably supported on the slider 36*a* by the pin 50 and the coil spring 56. A bearing 94*a* is supported on one end of the connector plate 90 by a fixed pin 92, whereas a shorter connector plate 98 is swingably supported on the other end of the connector plate 90 by means of a pin 96. The connector plate 98 has one end to which there is secured a fixed pin 100 supporting a bearing 94*b* thereon. The first arm 72 of the arm member 70 is coupled to an end of the fixed pin 100, and the second arm 74 of the arm member 70 is swingably coupled to the other slider 36*b*. More specifically, the slider 36*b* has a pin 50*a* by which a long connector plate 90*a* is swingably supported at one end on the slider 36*b*. The other end of the connector plate 90*a* is joined to a pin 96*a* which supports the second arm 74.

A stopper pin 102 is fixed to a lower end portion of the connector plate 90, with a coil spring 104 coupled between the stopper pin 102 and the connector plate 98.

A guide groove 64*a* is defined by two guide plates 62*a*, 62*b*. The guide groove 64*a* extends upwardly from an open lower end thereof and includes a first curved portion 106*a* located above the lower end and curved to the right (FIG. 4) and a second curved portion 106*b* located above the first curved portion 106*a* and curved upwardly to the left. The guide groove 64*a* has a substantially central portion opening laterally through a wide opening 108 defined between the guide plates 62*a*, 62*b*.

In operation, the rotatable drive source 22 is actuated to displace the arm member 70 downwardly through the sliders 36*a*, 36*b* to thereby press the suction cups 82 against the sheet film A to attract the same. In the subsequent upward movement, after the sheet film A has been swayed by angular movement of the suction cups 82, it is tilted so as to be directed toward the delivery rollers 88*a*, 88*b* (FIG. 5(*b*)), by which the sheet film A will be fed into the image recording section.

Figure 5:
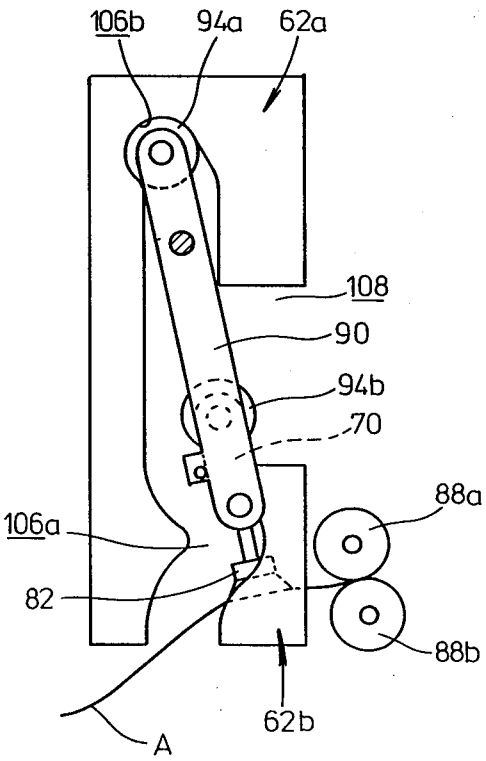
FIGS. 5(*a*) and 5(*b*) are elevational views showing successive steps of operation of the sheet feeding mechanism illustrated in FIG. 4.
Figure 5:
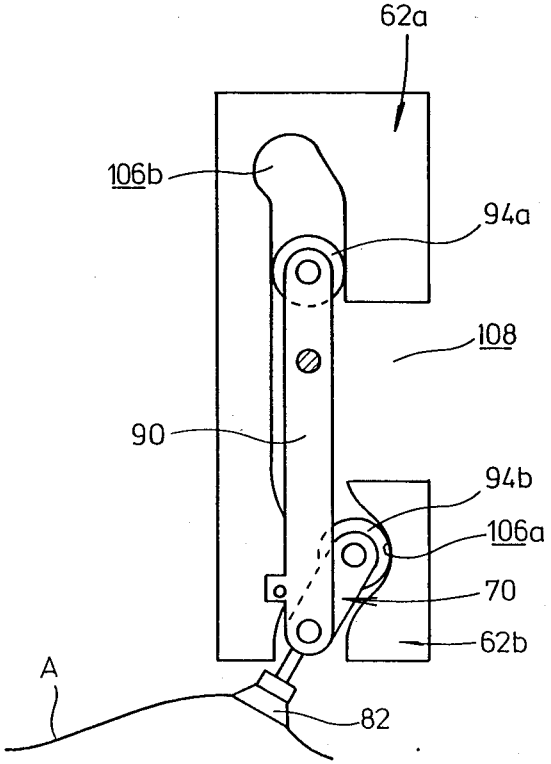

In the sheet feeding mechanism 20*a* of the second embodiment, as shown in FIGS. 5(*a*) and 5(*b*), the bearings 94*a*, 94*b* sway the sheet film A and feed the same to the rollers 88*a*, 88*b* in independent processes.

More specifically, the arm member 70 is displaced upwardly by energizing the rotational drive source 22. First, the bearing 94*b* is fitted into the first curved portion 106*a* to tilt the arm member 70 to curve and sway the sheet film A held by the suction cups 82, as shown in FIG. 5(*a*). Upon further upward movement of the arm member 70, the bearing 94*a* is shifted into the second curved portion 106*b*. At this time, the stopper pin 102 affixed to the connector plate 90 engages the connector plate 98 to tilt the arm member 70 in alignment with the connector plate 90. The sheet film A held by the suction cups 82 now has its leading end tilted so as to be directed toward the delivery rollers 88*a*, 88*b* (FIG. (*b*)). At this time, the bearing 94*b* enters the opening 108 to allow the arm member 70 to swing as desired. The vacuum suction device is de-activated to release the sheet film A, and the delivery rollers 88*a*, 88*b* are rotated to sandwich and deliver the sheet film A into the image recording section.

Figure 6:
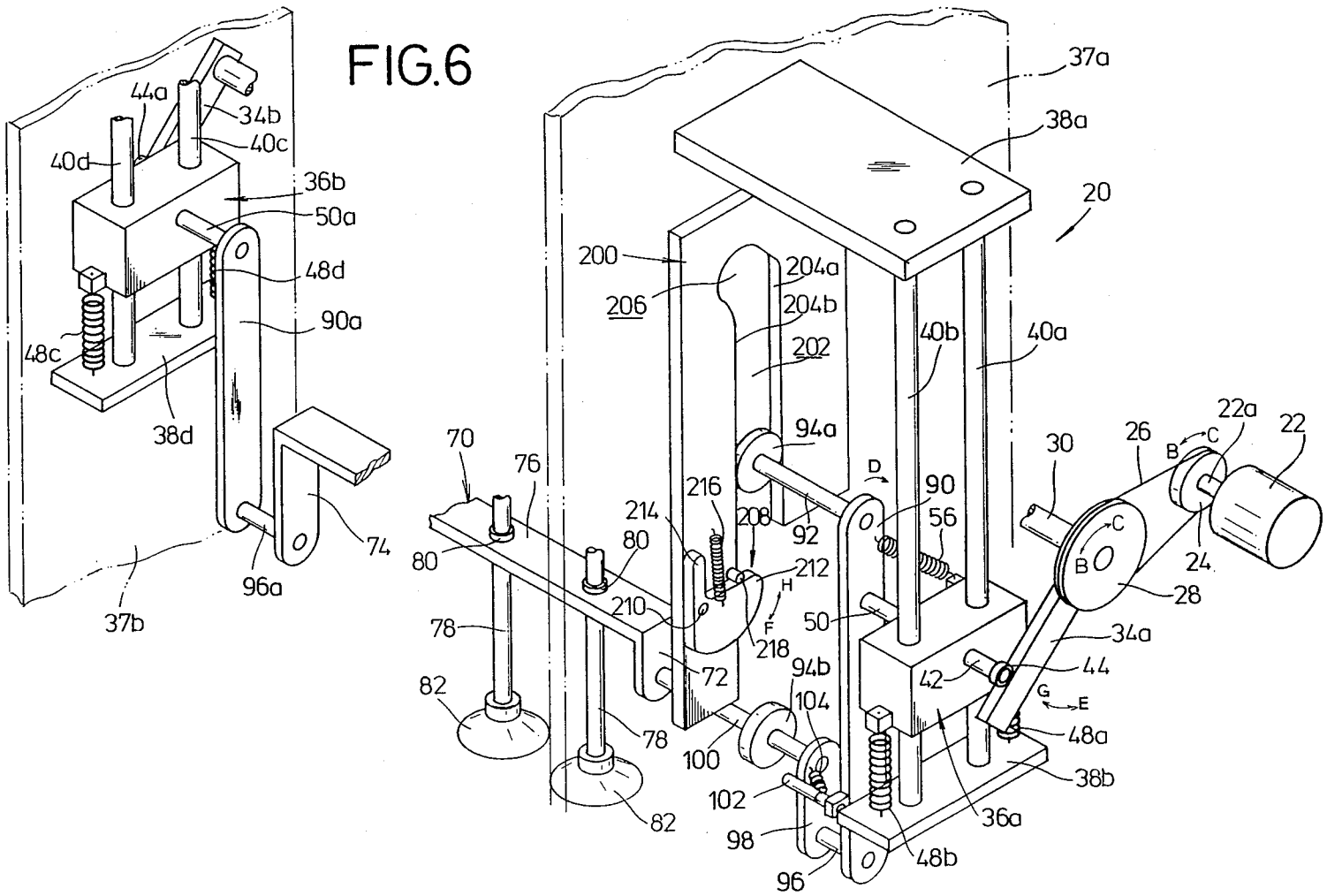
FIG. 6 is a fragmentary perspective view of a sheet feeding mechanism according to still another embodiment of the present invention.

FIG. 6 shows a sheet feeding mechanism according to still another embodiment of the present invention. In this embodiment, the guide plates 62 of the first embodiment or the guide plates 62*a*, 62*b* of the second embodiment are replaced by a guide plate or member 200.

The guide plate 200 is of an inverted L shape with a wider upper portion having a guide groove 202 defined therein. The guide groove 202 has an open lower end and is defined between wall surfaces 204*a*, 204*b* extending downwardly. The guide groove 202 has an opening 206 defined in its upper end and curved upwardly to the left.

A guide plate or member 208 is angularly movably mounted on a lower portion of the guide plate 200 by a pivot pin 210. The guide plate 208 has a curved portion 212 which can project rightwardly from the wall surface 204*b* by a prescribed distance. The guide plate 208 also has a vertically extending engaging finger 214 at an end remote from the curved portion 212. A resilient member 216 such as a coil spring has one end fixed to the guide plate 208 and the other end to the guide plate 200. A stopper pin 218 is mounted on the guide plate 200 adjacent to the guide plate 208. The guide plate 208 is normally urged by the tension of the coil spring 216 so as to be positioned by the stopper pin 218 as shown in FIG. 6. the coil spring 216 is not required to have a substantially large tensioning force, but may have a tensioning force large enough to keep the distal end of the curved portion 212 of the guide plate 208 in touch with the stopper pin 218.

The arm member 70 is displaced downwardly upon energization of the rotational drive source 22 while the bearing 94*a* is held in rolling contact with the wall surface 204*a* of the guide plate 200.

Figure 7:
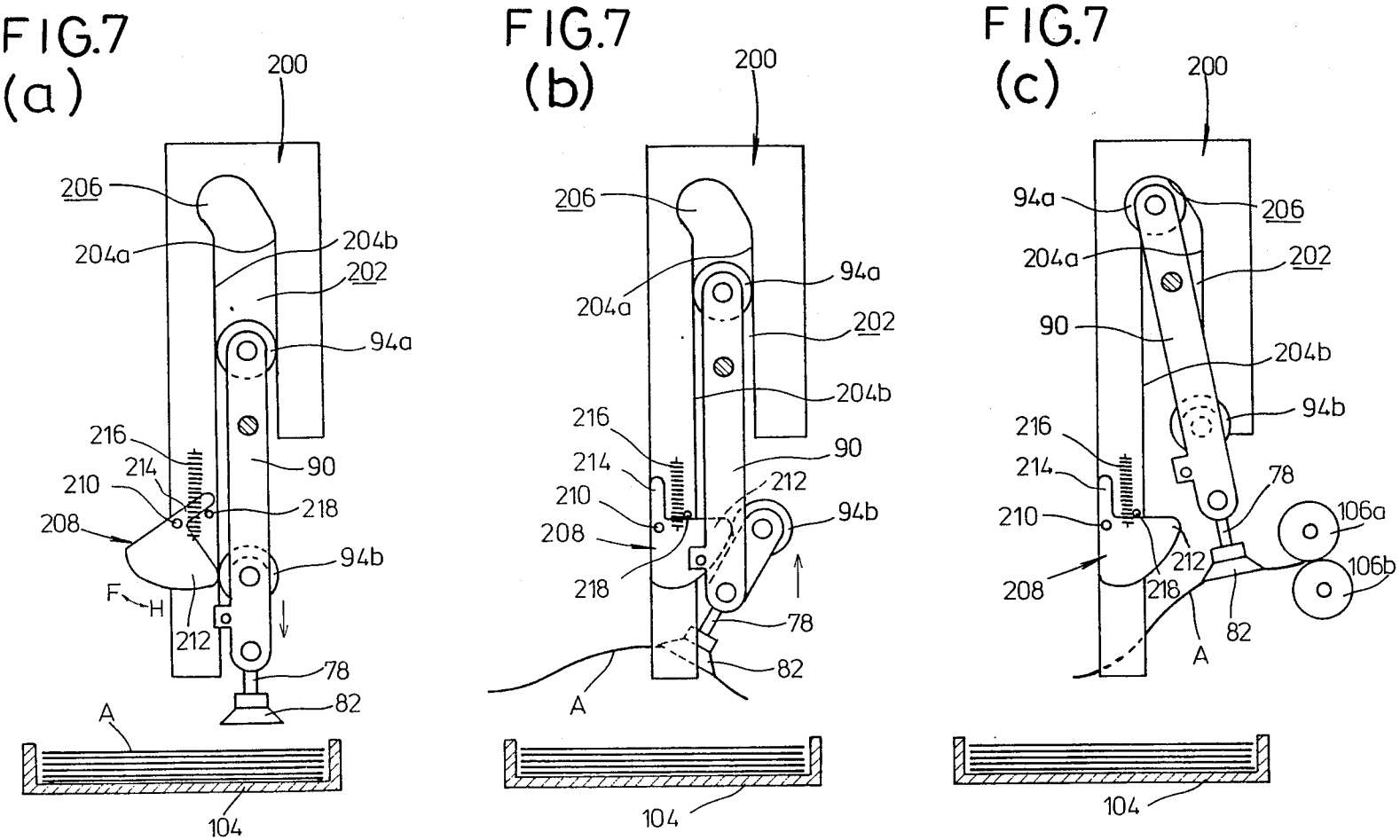
FIGS. 7(*a*), 7(*b*), and 7(*c*) are elevational views showing successive steps of operation of the sheet feeding mechanism illustrated in FIG. 6.

As the bearing 94*a* is moved downwardly, the bearing 94*b* is brought into engagement with the curved portion 212 of the guide plate 208. The guide plate 208 is now turned in the direction of the arrow F against the tension of the coil spring 216, so that the curved portion 212 is angularly displaced inwardly of the wall surface 204*b*, allowing the bearing 94*b* to descend along the wall surface 204*b*, as shown in FIG. 7(*a*). At this time, the engaging finger 214 of the guide plate 208 engages the stopper pin 218 to prevent the guide plate 208 from swinging excessively in the direction of the arrow F. After the bearing 94*b* has moved downwardly past the guide plate 208, the guide plate 208 springs back to the position of FIG. 6 in which the distal end of the curved portion 212 is held against the stopper pin 218 by the tension of the coil spring 216.

The vacuum suction device (not shown in FIG. 6) is then actuated to enable the suction cups 82 to hold the uppermost sheet film A in a magazine 104, after which the rotational drive source 22 is reversed. The sliders 36*a*, 36*b* are moved upwardly to cause the bearing 94*b* to abut against the guide plate 208 which is positioned by the stopper pin 218 under the bias of the coil spring 216.

Since the guide plate 208 is held by the stopper pin 218 against rotation in the direction of the arrow H, the bearing 94*b* rides onto and is moved along the curved edge of the curved portion 212 against the tension of the coil spring 104, as shown in FIG. 7(*b*). As a result, the arm member 70 is tilted to curve and sway the sheet film A held by the suction cups 82, thus releasing any other film or films which may have stuck to the sheet film A in the magazine 104.

The arm member 70 is continuously moved upwardly to bring the bearing 94*a* into the opening 206 to thereby swing the connector plate 90 against the bias of the coil spring 56. The stopper pin 102 fixed to the connector plate 90 engages the connector plate 98 to tilt the arm member 70 in alignment with the connector plate 90. Thus, the sheet film A held by the suction cups 82 is also tilted to direct its leading end toward delivery rollers 106*a*, 106*b*, as shown in FIG. 7(*c*). Upon de-energization of the vacuum suction device and rotation of the delivery rollers 106*a*, 106*b*, the sheet film A is sandwiched by the delivery rollers 106*a*, 106*b* and fed thereby into the image recording section (not shown).

With the present invention, as described above, identical suction cups and identical tubular bodies are securely mounted on the arm member, and the arm member is displaced by a guide member including a bearing or bearings fitted in and guided by a curved or bent guide groove to sway a sheet member held by the suction cups and thereby feed the sheet member. Even if stacked sheets stored in the magazine stick together due for example to static electricity, the sheets can be reliably separated and fed one by one from the magazine to the next processing step. The configuration of the guide groove in which the guide member is fitted may be suitably selected to vary the manner in which the sheet is taken out of the magazine. Therefore, stacked sheets can be fed one by one from a magazine even when the magazine is placed in a different postion or posture in the image recorder or the like.

The sheet feeding mechanism of the present invention may be employed to remove stimulable phosphor sheets, one by one, stacked in a radiation image recording or reading apparatus which constitutes a radiation image recording and reproducing system.

Although certain preferred embodiments have been shown and described, it should be understood that many changes and modifications may be made therein without departing from the scope of the appended claims.

What is claimed is:

1. A sheet feeding mechanism comprising:

suction means for holding and successively feeding sheets, said suction means including a plurality of suction elements coupled to a vacuum suction device;

an arm member on which said suction means is mounted;

a guide member operatively engaging said arm member and fitted in a guide opening having an at least partially non-linear profile; and means for displacing said guide member so that said guide member and said arm member follow said profile of said guide opening, said profile having at least two portions for angularly moving said arm member to sway and subsequently feed a sheet held by said suction elements as said guide member is moved along said guide opening.

2. A sheet feeding mechanism according to claim 1, wherein said arm member is swingably supported on a slider comprising a part of said drive means, said guide member comprising a rotatable member coupled to said arm member, said guide opening being defined in at least one guide plate, at least one of said portions being curved or bent, said rotatable member being fittable in said curved or bent portion during reciprocating movement of said slider upon operation of said drive means for angularly moving said arm member with respect to said slider to sway the sheet held by said suction means.

3. A sheet feeding mechanism according to claim 2, wherein said first and second portion are curved portions, said rotatable member being fittable in said first curved portion to swing said arm member to sway the sheet held by said suction means to prevent a plurality of sheets from being fed simultaneously, and said rotatable member being subsequently fittable in said second curved portion to swing said arm member to tilt an end of said sheet toward a nip between a pair of delivery rollers.

4. A sheet feeding mechanism according to claim 2, said drive means further including connector plate means swingably supported on said slider, said guide opening having first and second portions being curved portions, said guide member comprising a first rotatable member mounted on one end of said connector plate means, and a second rotatable member, said arm member and said second rotatable member being mounted at the other end of said connector plate means for swinging movement in one direction, said second rotatable member being fittable in said first curved portion to swing said arm member to sway the sheet held by said suction cups to prevent simultaneous feeding of a plurality of sheets, said first rotatable member being fittable in said second curved portion to swing said connector plate means and said arm member in unison to tilt an end of said sheet toward a nip between a pair of delivery rollers.

5. A sheet feeding mechanism comprising:

suction means for holding and successively feeding stacked sheets, said suction means including a plurality of suction elements coupled to a vacuum suction device;

an arm member on which said suction means is mounted; and a first fixed guide member and a second movable guide member for controlling movement of said arm member along respective distinct portions of a prescribed path; such second guide member including profile means for swingably displacing said arm member to sway a sheet held by said suction elements when said arm member traverses a first prescribed portion of said path.

6. A sheet feeding mechanism according to claim 5, wherein said second guide member is angularly movably supported on said first guide member and biased toward a first angular portion, said second guide member having a contour extending beyond a contoured surface of said first guide member for swinging said arm member, said second guide member being angularly moved by said arm member against said bias to allow said arm member to be moved along said first guide member when said arm member moves toward said stacked sheets, and said arm member being swingably displaced along said contour of said second guide member to sway said sheet when said arm member is moved away from said stacked sheets.

7. A sheet feeding mechanism according to claim 6, further including a stopper pin mounted on said first guide member, said second guide member being biased into engagement with said stopper pin said second guide member being prevented by said stopper pin from being angularly moved when said arm member is being swingably displaced along said contour.

8. A sheet feeding mechanism according to claim 7, wherein said second guide member includes an engaging finger, said engaging finger being engageable with said stopper pin to limit angular movement of said second guide member when said arm member angularly moves said second guide member upon displacement toward said stacked sheets.

9. A sheet feeding mechanism according to claim 5, wherein said first guide member includes a curved or bent portion defining a second prescribed portion of said path, said arm member being swingably displaced by said curved or bent portion when being moved along said second prescribed portion of said path, to tilt an end of said sheet toward a nip between a pair of delivery rollers.

10. A sheet feeding mechanism according to claim 5, further including a rotatable member mounted on said arm member, means for resiliently urging said rotatable member into rolling contact with guide surfaces of said first and second guide members, and means for reciprocally displacing said arm member to displace said rotatable member along said guide surfaces.

* * * * *